US005798735A

United States Patent [19]

Walton, Jr.

[11] Patent Number: 5,798,735

[45] Date of Patent: Aug. 25, 1998

[54] HOT AIR DE-ICING OF SATELLITE ANTENNA WITH COVER

[76] Inventor: William B. Walton, Jr., 5607 Ave. Juan Bautista, Riverside, Calif. 92509

[21] Appl. No.: 530,588

[22] Filed: Sep. 19, 1995

[51] Int. Cl.[6] ..... H01Q 1/02

[52] U.S. Cl. ..... 343/704; 343/872; 392/422

[58] Field of Search ..... 343/704, 840, 343/912, 872; 392/422, 420, 407; H01Q 1/02

[56] References Cited

U.S. PATENT DOCUMENTS

| | | | |
|---|---|---|---|
| D. 268,343 | 3/1983 | Mann et al. | D14/90 |
| D. 304,454 | 11/1989 | Serres | D14/231 |
| D. 305,334 | 1/1990 | Marr | D14/230 |
| 4,126,864 | 11/1978 | Hopkins | 343/704 |
| 4,213,029 | 7/1980 | Endicott, Jr. et al. | 343/704 |
| 4,259,671 | 3/1981 | Levin | 343/704 |
| 4,368,471 | 1/1983 | Walton, Jr. | 343/704 |
| 4,479,131 | 10/1984 | Rogers et al. | 343/872 |
| 4,536,765 | 8/1985 | Kaminski | 343/704 |
| 4,581,615 | 4/1986 | Levy | 343/872 |
| 4,804,972 | 2/1989 | Schudel | 343/872 |
| 4,866,452 | 9/1989 | Barma et al. | 343/704 |
| 4,918,459 | 4/1990 | De Teso | 343/872 |
| 4,955,129 | 9/1990 | McCauley et al. | 29/611 |
| 4,972,197 | 11/1990 | McCauley et al. | 343/704 |
| 5,010,350 | 4/1991 | Lipkin et al. | 343/704 |
| 5,353,037 | 10/1994 | Jones | 343/704 |
| 5,368,924 | 11/1994 | Merrill, Jr. et al. | 343/872 |
| 5,451,972 | 9/1995 | Franklin | 343/872 |

FOREIGN PATENT DOCUMENTS

| | | | |
|---|---|---|---|
| 57-65033 | 4/1982 | Japan | 343/704 |
| 58-151702 | 9/1983 | Japan | 343/704 |
| 59-207701 | 11/1984 | Japan | 343/704 |
| 2-34004 | 2/1990 | Japan | H01Q 1/02 |
| 2-109402 | 4/1990 | Japan | H01Q 1/02 |

*Primary Examiner*—Hoanganh T. Le

*Attorney, Agent, or Firm*—Knobbe, Martens, Olson & Bear, LLP

[57] ABSTRACT

A system for preventing the interruption of satellite communications between an earth antenna and a satellite during inclement weather. The system is comprised of a cover, which covers the antenna and substantially prevent the accumulation of snow and precipitation on the antenna, and a heating system which provides heated air to a space between the cover and the antenna to inhibit snow from sticking to the cover and also to inhibit the formation of frozen moisture on the cover during freezing rain and freezing fog conditions. In one embodiment, the system has an electric heater and a blower system which draws air from the space between the cover and the antenna, heats this air and then recirculates the heated air back to the space.

13 Claims, 4 Drawing Sheets

HOT AIR DE-ICING OF SATELLITE ANTENNA WITH COVER

BACKGROUND OF THE INVENTION

1. Field of the Invention

The present invention relates to satellite antennas and, in particular, concerns a system for heating an earth based satellite antenna which includes a cover to be installed on the front face of the antenna and a heater that supplies heat to the cover to prevent accumulations of snow and ice on the cover.

2. Description of the Related Art

Satellite communication systems are becoming increasingly popular in today's world. For example, satellite communication systems are being used by networks of stores for providing inventory information between stores and these systems are also used for credit transactions. In particular, satellite communication systems have increasingly been used by retail stores to approve credit card transactions by individual customers. The primary advantage of satellite communications is that the information can be transmitted to a satellite and then returned to a distant ground station much quicker than the information can be transferred via the telephone lines.

The increasing use of satellite communications has resulted in the installation of many satellite dish antennas in colder climates. One particular problem with positioning satellite dish antennas in colder climates is that snow or freezing rain can accumulate in the dish of the antenna. The accumulations of snow or ice in the dish of the antenna can further result in an interruption of signals between that particular satellite antenna and the satellite. It will be appreciated that satellite networks in colder climates can be particularly vulnerable to interruption of the transfer of information on these systems during winter storms and the like. several features have been developed in the past to address the problem of accumulations of snow and ice in satellite dish antennas. Satellite antennas have been equipped with fabric covers to prevent snow and ice from accumulating inside of the dish of the antenna. These covers are preferably made of a material that does not interfere with the signals travelling between the satellite and the antenna. One difficulty with these covers, however, is that, while these covers are generally successful in keeping snow and water from accumulating inside of the dish, these covers will quite often be coated by snow or frozen water in certain conditions. In particular, when there is a wet snow, the wet snow has a tendency to stick to the outside cover of the satellite dish. Similarly, when weather conditions are producing sleet or freezing fog, the frozen ice can also accumulate on the outside cover of the antenna. When either of these conditions occur, communications between the satellite and the earth based antenna can be interrupted.

Another approach taken by satellite antenna manufacturers is to heat the dish antenna so that the surface of the dish antenna is sufficiently warm so as to prevent snow and ice from sticking to the inner surface of the dish antenna. However, it will be appreciated that if the weather conditions are severe enough, the snow and ice will continue to accumulate on the interior of the antenna even though the interior surface of the antenna may be heated above freezing. For example, in a very heavy blizzard the interior surface of the antenna dish may be covered with snow even though the interior surface of the antenna is heated. One such example of a heating system that heats the interior surface of the antenna, and in particular, a plenum chamber positioned adjacent the back side of the antenna, is U.S. Pat. No. 4,368,471 to Walton, Jr.

From the foregoing it is apparent that there is a need for a system that reduces the disruption of communications between satellites and earth based antennas as a result of inclement weather. To this end, there is a need for an improved system of preventing accumulations of snow and ice, and in particular, preventing accumulations of wet snow or ice from interrupting communications between a satellite and a ground based antenna.

SUMMARY OF THE INVENTION

The aforementioned needs are satisfied by the de-icing system for earth based satellite antennas of the present invention which is comprised of a cover, that is configured to cover the front opening of an antenna, and a heating system that is configured to heat the cover so that the cover is maintained at a temperature which reduces the accumulation of ice and snow on the cover. Preferably, the cover is comprised of a material that does not interfere with communication signals between the antenna and the satellite and is also preferably configured to be mounted on the antenna so as to prevent the accumulation of snow and ice on the inner reflecting surfaces of the antenna. Further, the heating system is preferably mounted on the back side of the antenna and provides heated air to the space between the reflecting surfaces of the antenna and the outside cover so as to maintain the cover at a temperature above freezing.

In the preferred embodiment, the heating system includes a blower which blows heated air into the space between the antenna and the cover via an intake tube. Further, there is an exhaust tube that collects air from the space between the antenna and the cover and provides it to the heater. Hence, in the preferred embodiment the heater is a closed-loop heating system that continuously recirculates warm air through the space between the cover and the antenna body. Further, in the preferred embodiment, the intake tube is connected to an intake fitting that is configured so as to mount on the lip of the antenna and provide the warm air through an opening in the cover. Further, the intake fitting is configured to have vanes which cause the heated air from the heater and blower to circulate in a generally circular fashion so as to warm substantially all of the cover. A similar outlet fitting is mounted on the antenna and withdraws air from the space and provides the air to the heater for further recirculation. In one particular application, for an antenna having a 1.2 meter diameter, an 800 watt heater with a blower configured to blow air at a rate of 100 CFM is capable of warming the outside cover and maintaining the outside cover at a temperature above freezing. In most weather conditions that would prevent wet snow or freezing fog, that would otherwise stick to the outside cover of the antenna, from sticking.

Hence, from the foregoing, the preferred embodiment provides a system which is capable of covering the outside of an antenna so as to prevent the accumulation of snow and ice on the interior surface of the antenna and is also capable of warming the cover so as to prevent the accumulation of wet snow, freezing fog, or freezing rain on the outside cover of the antenna. Further, the system of the preferred embodiment is readily adaptable to existing antennas and does not substantially interfere with communications going to and coming from the antenna. These and other objects and features of the present invention will become more fully apparent from the following description and appended claims taken in conjunction with the accompanying drawings.

DETAILED DESCRIPTION OF PREFERRED EMBODIMENT

Figure 1:
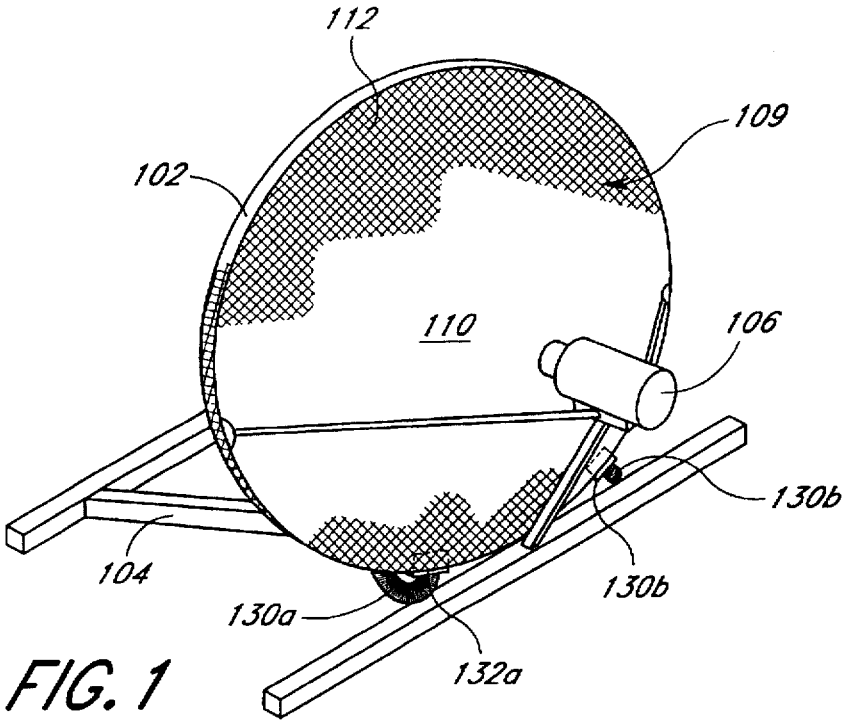
FIG. 1 is a front perspective view of a typical satellite communications antenna equipped with the heating system of the preferred embodiment.

Reference will now be made to the drawings wherein like numerals refer to like parts throughout. Referring now to FIG. 1, an earth satellite antenna 100 is illustrated which is generally comprised of an antenna dish 102 that is mounted on a frame 104 and a collector 106 that is positioned in front of a front side 109 of the antenna dish 102 so as to collect signals reflected from a reflecting surface 110 of the dish 102. In the embodiment shown in FIG. 1, the front side 109 of the antenna dish 102 is generally circular in shape and has a concave configuration. Specifically, the antenna dish 102 is concave so that any signal impinging upon the reflecting surfaces 110 is reflected towards the collector 106.

In the embodiment shown in FIG. 1, a cover 112 is also mounted on the front side 109 of the antenna dish 102. The cover 112 is preferably stretched taut over the concave opening of the antenna dish 102 so as to prevent snow and other precipitations from accumulating on the reflecting surfaces 110 on the inside of the dish 102. In the preferred embodiment, the cover is made of a polyester material or a material coated with polytetrafluoroethylene such as Teflon cloth, such as the cloth sold under the Gortex trademark. It will be appreciated that the cover 112 should preferably be made of some water resistant material that does not inhibit the transmission of satellite communications signals to and from the antenna dish 102.

Figure 2:
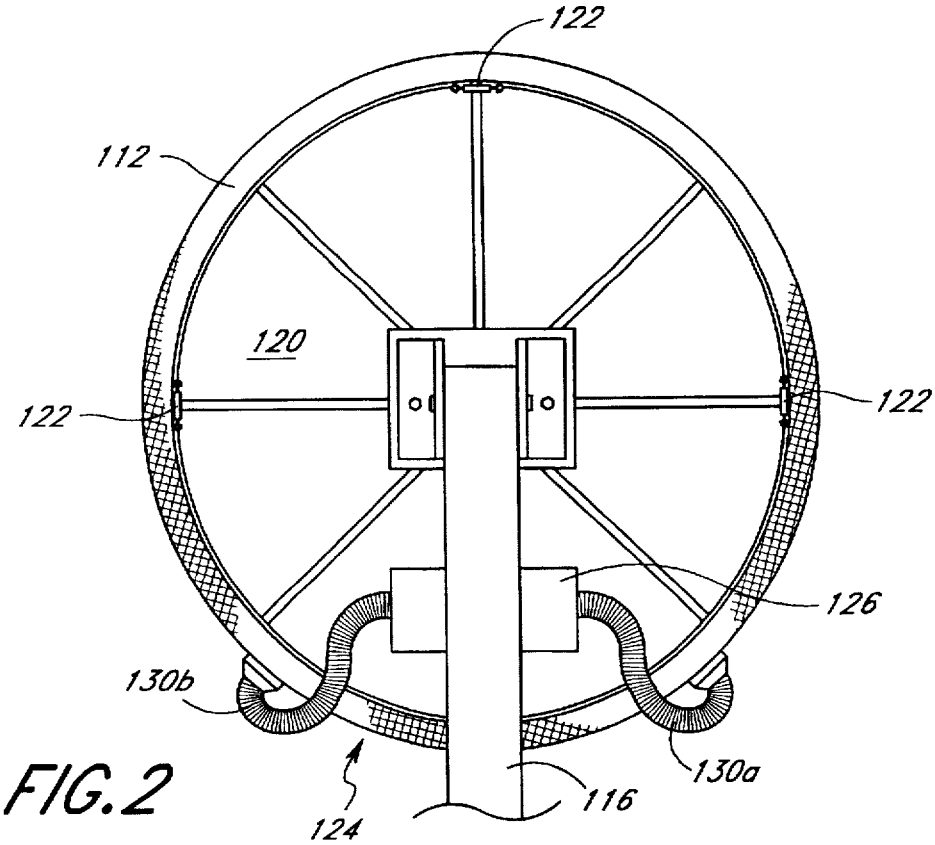
FIG. 2 is a rear perspective view of the antenna shown in FIG. 1 with the heating system of the preferred embodiment installed thereon.

FIG. 2 illustrates a back side 114 of the satellite antenna 100 in greater detail. In particular, the earth satellite antenna 100 is mounted on a vertical support 116 in a well-known manner that permits the antenna dish 102 to be oriented in a desired vertical and horizontal orientation and then fixed in the desired orientation. Further, in this embodiment, the antenna dish 102 is constructed of a number of segments 120 of a desired shape. As is also shown in FIG. 2, the cover 112 is stretched completely over the opening in the front side 109 of the antenna dish 102 and extends onto the back side 114 wherein a spring cable and turnbuckle assembly 122 securely retains the cover 112 on the antenna dish 102 in a well-known manner. It will, however, be appreciated that any number of methods can be used to secure the cover on the antenna dish 102, including positioning elastic material at the outer periphery of the cover 112, that would retain the cover 112 on the antenna dish 102 so as to substantially cover the front side 109 of the antenna dish 102 without departing from the present invention.

It will be appreciated that since the antenna dish 102 in the preferred embodiment is concave, positioning the cover 112 so as to be taut across the front face 109 of the antenna dish 102 results in a space 111 being defined between the reflecting surfaces 110 of the antenna dish 102 and the cover 112. This space is further illustrated in FIGS. 3C and 3D.

As will be described in greater detail hereinbelow, the heating system 124 provides heat into the space 111 so as to preferably maintain the cover 112 at a temperature that will prevent snow and ice from forming on the outside surface of the cover and interrupting communications between the antenna assembly 100 and a satellite.

FIG. 2 also illustrates that a heating system 124 is mounted on the vertical support 116 of the antenna 100. In particular, the heating system 124 includes an enclosure 126 that contains components of the heating system 124, that will be described in greater detail hereinbelow, and two tubes **130*a* and 130*b* which are respectively a heat inlet tube 130*a* and a heat outlet tube 130*b*. As shown in FIG. 1, the tubes 130*a* and 130*b* are positioned within openings 132*a* and 132*b* respectively in the cover 112 on the front side of the antenna dish 102. As will be described in greater detail hereinbelow, the heating system 124 provides heat to the space between the cover 112 and the reflecting surface 110 of the antenna dish 102 so as to maintain the cover 112 at a temperature sufficient to prevent the accumulation of snow and ice on the cover 112. While in the embodiment shown in FIG. 2 the heating assembly 124, and in particular the heater enclosure 126, is shown as mounted on the vertical support 116 of the antenna 100, it will be appreciated that the heater enclosure can be mounted in any of a number of locations on or adjacent to the antenna 100** without departing from the present invention.

Figure 3A:
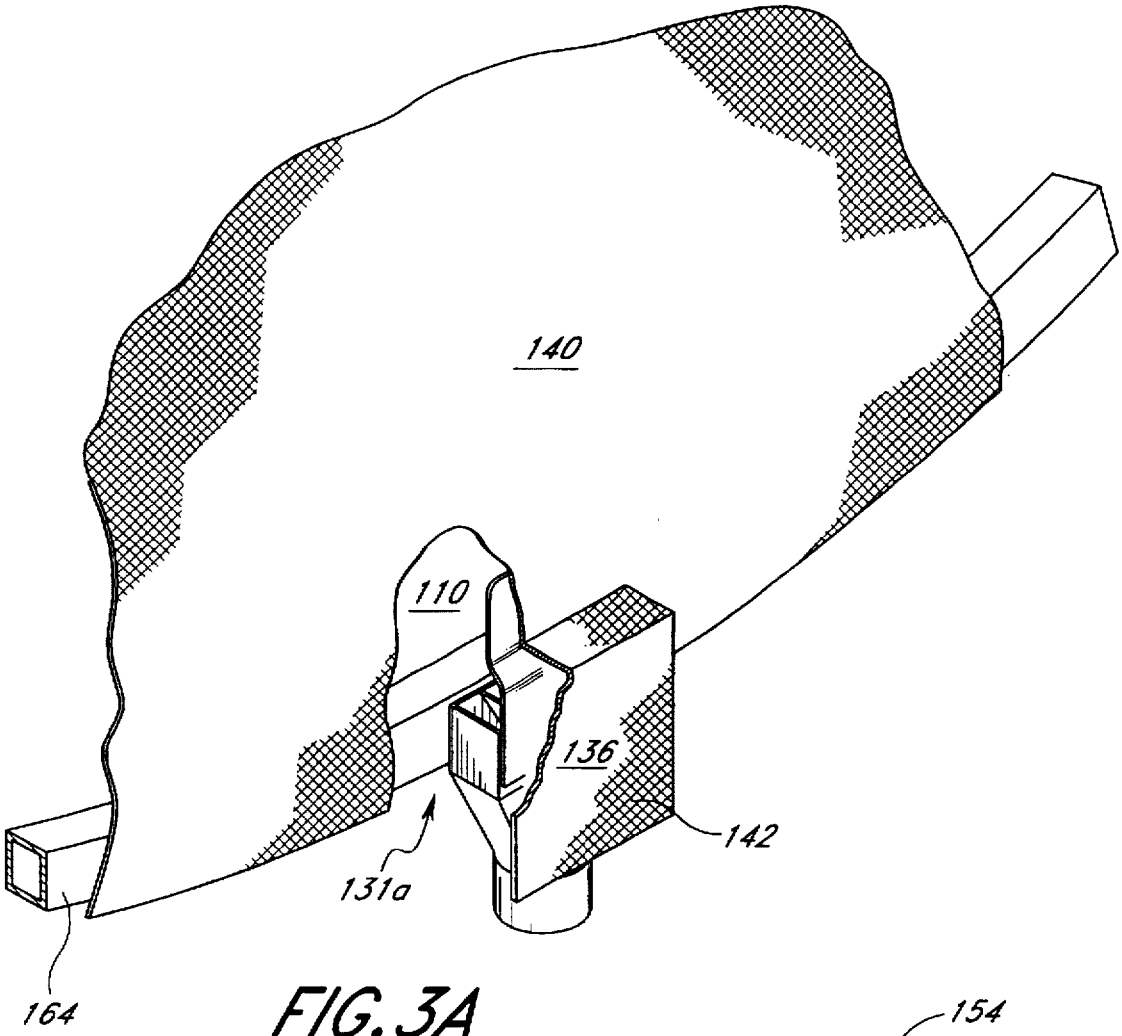
FIG. 3A is a detailed perspective view of an intake fitting which provides heated air to the space between the cover and the antenna.

Referring now to FIG. 3A, the inlet opening **132*a* in the cover 112 is illustrated in greater detail. The following description in reference to FIGS. 3A–3D describes the inlet opening 132*a* and an associated inlet fitting 134*a*, however, the outlet opening 132*b* and an outlet fitting 134*b* are nearly identical in construction. Specifically, in the preferred embodiment the cover 112 is configured to have a generally rectangular pouch 136 that extends outward from a main portion 140 of the cover 112 so as to define the opening 132*a*. The rectangular pouch 136 has a flap 142 that on the underside has an attaching surface such as a hook and loop material. As shown in FIG. 3A there is an inlet fitting 134*a* that is configured to be connected to the inlet tube 130*a* that is positioned in the pouch 136 so that the inlet fitting 134*a* extends into the opening 132*a* in the cover 112**.

Figure 3B:
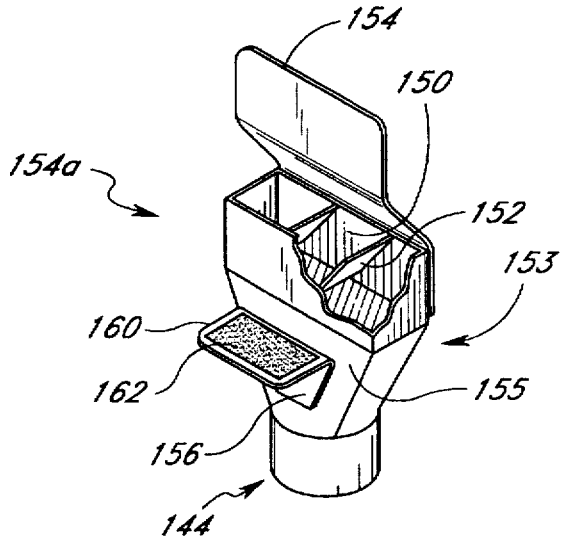
FIG. 3B is a detailed perspective view of the intake fitting shown in FIG. 3A.

The inlet fitting **134*a* is illustrated in greater detail in FIG. 3B. In particular, the inlet fitting 134*a* has a hollow circular section 144 that is open at one end that is configured to receive the inlet tube 130*a* in the manner shown in FIG. 2. Specifically, the inlet tube 130*a* is positioned over the circular section 144 in the inlet fitting 134*a*. The circular section 144 is then connected to a generally rectangular hollow section 146 that has a rectangular opening 150 at the end opposite the circular section 144. The rectangular section 146 has two directing vanes 152 adjacent the opening 150 that direct heat, emanating from the inlet fitting 144, in a generally clockwise direction in the space 111 in the manner that will be described hereinbelow in conjunction with FIG. 5. Further, there is a flange 154 positioned on a top side 153 of the inlet fitting 134*a* that is configured to ensure that the cover 112 is not blocking the rectangular opening 150 and preventing heat from passing from the inlet fitting 134 into the space 111**.

Figure 3C:
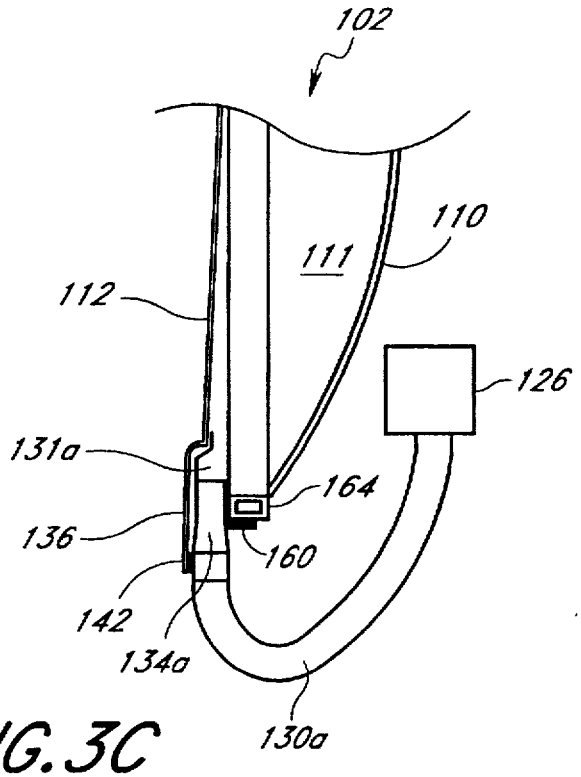
FIG. 3C is a sectional view of the cover and the satellite antenna having the system of FIG. 1 installed thereon further illustrating the mounting of the intake fitting and the cover.

Further, as illustrated in FIG. 3B, on a bottom side 155 of the inlet fitting 134*a* there is a mounting flange 156 positioned thereon. The mounting flange 156 is a generally L-shaped piece of material having a mounting plate 160 that extends in a direction generally perpendicular to the bottom side 155 of the inlet fitting 134*a*. Preferably, the mounting plate 160 has a piece of hook and loop material 162, e.g., Velcro material, positioned thereon. As illustrated in FIG. 3C, the mounting plate 160 is positioned adjacent an outer rim 164 of the antenna dish 102 when the inlet fitting 134*a* is positioned in the opening 130*a*. Preferably, a matching piece of hook and loop material is positioned on an outer rim 164 of the antenna dish 102 so that the material 161 on the mounting plate 160 engages with the material on the outer rim 164 of the antenna dish 102 to securely maintain the inlet fitting 134 in the opening 130 in the cover 112. Further, as is also shown in FIG. 3C, hook and loop material is also mounted on the underside of the flap 142 of the pouch 132*a* and on the top surface 153 of the fitting so that the flap 142 is securely attached to the upper surface 153 of the fitting 134*a* to further maintain the fitting 134*a* in the desired orientation shown in FIG. 3A. Hence, the fitting is positioned within the pouch 132*a* so that the rectangular opening 150 allows for air to be introduced through the opening 130*a* in the cover 112 and the fitting 134*a* is retained in this position by the detachable engagement between the hook and loop material on the mounting plate 160 and the upper surface 153 of the fitting 134*a*. It will be appreciated, however, that alternative forms of securing the fitting 134*a* to the rim 164 of the antenna dish 102 and to the flap 142 of the pouch 136 can be used without departing from the present invention. For example, snaps, glue and other types of securing means can be used.

Figure 3D:
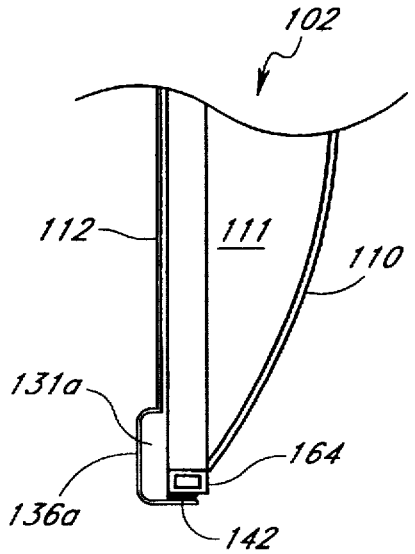
FIG. 3D is a sectional view of the cover and the satellite antenna of FIG. 3C, wherein the intake fitting has been removed and the cover has been secured to the antenna frame.

FIG. 3D illustrates that the cover 112 is configured so that when the heating system 124 of the present invention is not being used, the bottom side of the flap 142 can engage with the rim of the antenna 164 to close the cover 112 about the antenna dish 102. Hence, the cover 112 can be used in conjunction with the heating system 124 for dynamically heating the space 111 between the cover 112 and the reflecting surface 110 of the antenna dish 102 or the cover 112 can be installed on the antenna dish 102 to passively prevent the accumulation of snow and ice and other moisture on the concave reflecting surfaces 110 of the antenna dish 102.

Figure 4:
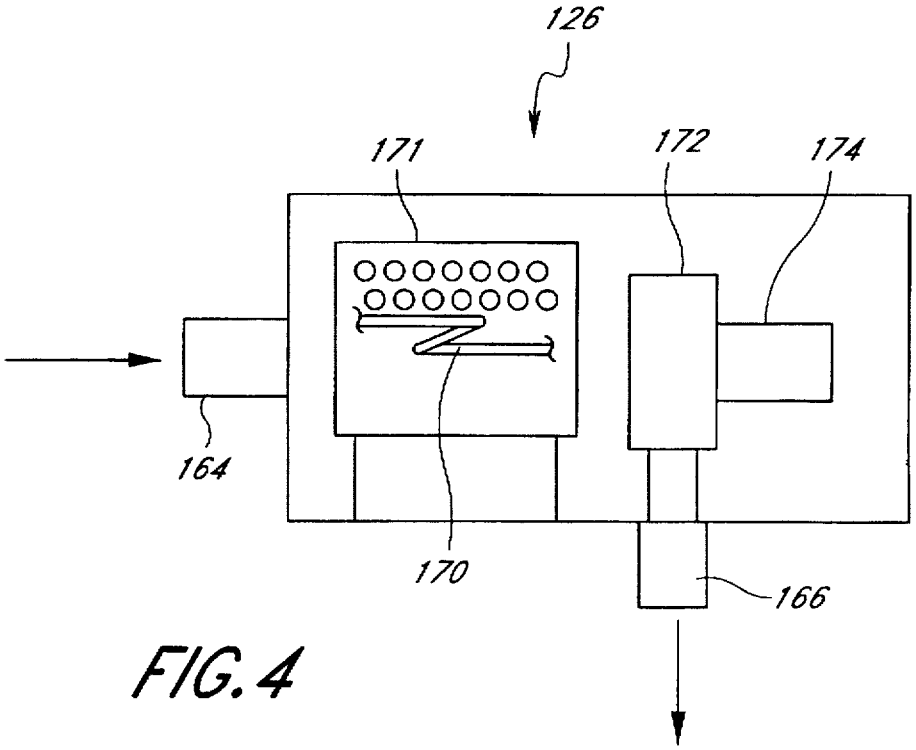
FIG. 4 is a detail of the heater/blower assembly which is a component of the heating system of the preferred embodiment.

FIG. 4 schematically illustrates the heater enclosure 126 which forms a portion of the heating system 124. The heater enclosure 126 is preferably a rectangular box that has a heating element 170 and a blower 172 with an associated blower motor 174 positioned therein. The heating element 170 is positioned within the heater enclosure 126 so that an air intake opening 164 in the enclosure provides air directly to the heating element 170. Further, the blower 172 is configured to draw air from the intake opening 164 in the enclosure 126, through the coils of the heating element 170 and then exhaust the air through an enclosure exhaust opening 166.

Preferably, the intake opening 164 of the enclosure is connected to the outlet tube 130*b* (FIG. 1) whereby air from the space 111 between the cover 112 and the concave surface 110 of the antenna is provided to the heating element 170 and is reheated. Similarly, the exhaust opening 166 in the heater enclosure 126 is connected to the inlet tube 130*a* (FIG. 1) that provides the heated air from the heater enclosure 126 to the space between the cover 112 and the concave surface 110 of the antenna dish 102.

Hence, in the preferred embodiment, the blower 172 draws air out of the space 111 through the tube 130*b* and then through the heating element 170 to reheat this air. Subsequently, the blower 170 then exhausts this heated air out through the exhaust opening 166 through the tube 130*a* and the tube 134*a* back into the space 111 between the cover 112 and the concave surface 110 of the antenna dish 102. Consequently, a closed loop heating circuit is established whereby heated air is recirculated through the space 111 between the cover and the antenna dish.

Preferably, the blower 172 and the heating element 170 is configured to provide sufficient heated air to the space 111 so that the cover 112 is maintained at a temperature which inhibits wet snow from sticking to the cover 112 and further inhibits formation of ice particles on the cover 112 as a result of freezing rain and freezing fog. In one embodiment, for a 1.2 meter satellite dish, the heating element is an 800 Watt electrical heating element that is bent in a generally helixical fashion. The heating element is available from Chromolux and is mounted within the enclosure 126 so that the center axis of the heating element is positioned substantially in front of the intake opening 164 so that air is drawn through the center of the helixical heating element. Further, the blower is a 100 CFM blower that uses a 1/70 th horsepower motor to draw the air from the space through the heating element 170 and then back to the space. It will be appreciated that the enclosure 126 also includes the requisite protection and control circuitry used to control and protect the heating element and the motor during operation.

It will further be appreciated that many types of heaters and heating systems and blower and blower systems can be used to provide heat to the space between the cover 112 and the concave surface 110 of the antenna dish 102. For example, for larger antennas it may be desirable to use a gas heating system such as the gas heating system that is currently available from WB Walton Enterprises, Inc. of Riverside, Calif. Further, the exact heat output of the heater and the air transfer capability of the blower is, of course, dependent upon the size of the antenna dish and is also dependent upon the temperatures to which the antenna dish is likely to be exposed. It will further be appreciated that the enclosure 126 can be equipped with a sensing system, such as the sensing systems currently available from WB Walton Enterprises, Inc., that will turn the heating system 124 on during particular weather conditions. For example, the sensing system may include a sensor which detects when the air temperature is low enough for snow and ice to form and then automatically activate the heating system 124 to provide heated air to the space 111.

Figure 5:
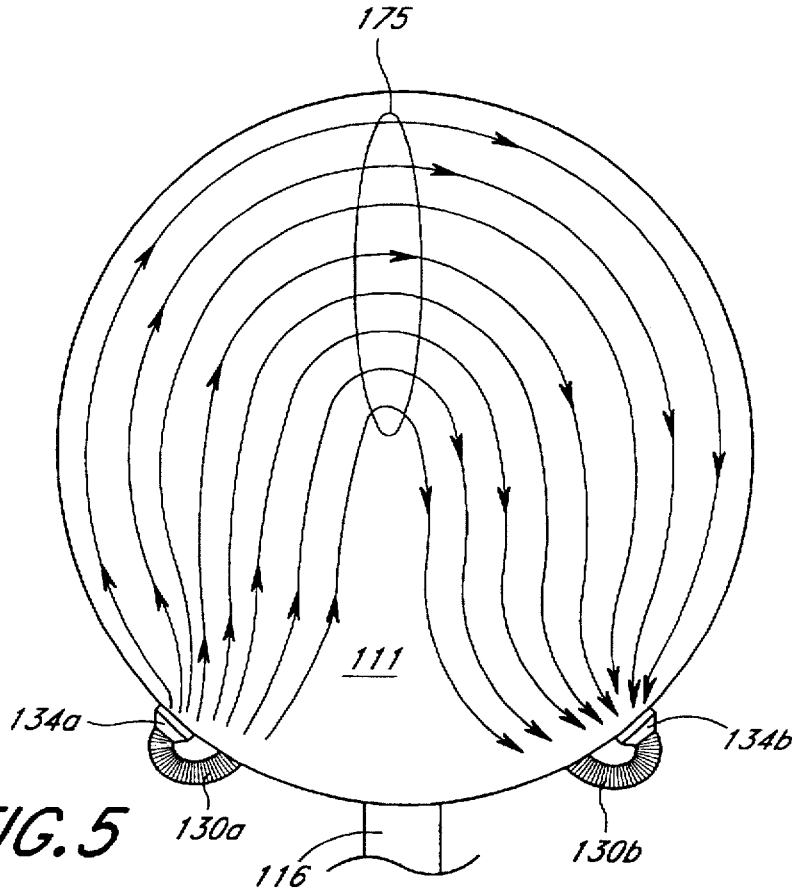
FIG. 5 is a schematic view of the satellite antenna illustrating the airflow in the space between the antenna dish and the cover.

FIG. 5 is a schematic illustration which illustrates how the heated air provided by the heating system 124 is circulated through the space between the cover 112 and the concave surface 110 of the antenna dish 102. Specifically, the vanes 152 on the inlet fixture 134*a* (FIGS. 3A, 3B) in this embodiment induce the heated air to travel around the space 111 in a generally clockwise fashion as illustrated by the arrows 175. The outlet fitting 134 is substantially identical to the inlet fitting 134*a* described above in conjunction with FIG. 3A except that the vanes 152 are positioned so as to angle to the right. This further contributes to the circulation of the heated air through the space 111 in the clockwise manner shown. It will be appreciated that this circulation of heated air underneath the cover 112 maintains the cover 112 at a temperature which inhibits the formation of snow and ice on the cover and thereby inhibits the interruption of communication signals to and from the satellite dish antenna 100 during inclement weather.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. A system for heating a satellite antenna having an outer lip and a front reflecting surface comprising:

a single layered cover having an opening which has a perimeter selected so that the opening is mounted on said outer lip of said antenna with the cover positioned over said front reflecting surface of said satellite antenna so as to define an enclosed unobstructed space between said front reflecting surface of said antenna and said cover, whereby said cover reduces accumulations of snow and water on said front reflecting surface of said satellite antenna while permitting satellite signals to pass therethrough and wherein said cover further includes at least one opening to permit heat to be provided to said enclosed unobstructed space; and a heating system which circulates heated air into said enclosed unobstructed space between said front surface of said antenna and said cover so as to heat said front reflecting surface of said antenna and so as to maintain said cover at a temperature sufficient to reduce accumulations of snow and ice on said cover wherein the heating system includes a heat source, a blower and an inlet tube which is coupled between said blower and said enclosed unobstructed space via said at least one opening in said cover so that heated air is blown from said heat source through said inlet tube into said enclosed unobstructed space.

2. The system of claim 1, wherein said cover is formed out of a material coated with polytetrafluoroethylene.

3. The system of claim 1, wherein the at least one opening in said cover includes an inlet opening, which is coupled to said inlet tube of said heating system, and an outlet opening and wherein said heating system includes an outlet tube which is connected to said outlet opening so as to remove air from said space between said cover and said front reflecting surface of said antenna.

4. The system of claim 3, wherein said outlet tube is in communication with said heating element so that air removed from said space between said cover and said front reflecting surface of said antenna is heated by said heating element and blown by said blower so as to be returned through said inlet tube and said inlet opening into said space between said cover and said front reflecting surface of said antenna.

5. The system of claim 4, further comprising an inlet fitting and an outlet fitting wherein said inlet fitting is connected to said inlet tube and is positioned in said inlet opening so that said inlet fitting provides heated air from said inlet tube to said space and wherein said outlet fitting provides air from said space to said outlet tube.

6. The system of claim 5, wherein said inlet fitting and said outlet fitting includes vanes which are configured to circulate said heated air around said dish antenna so as to warm substantially the entire surface of said cover.

7. A system for reducing interruptions of communications between satellites and a satellite antenna having a front concave surface and an outer lip, comprising:

a cover having an opening which has a perimeter selected so that the opening is mounted on said outer lip of said antenna with the cover positioned over said front concave surface of said antenna so as to define an enclosed unobstructed space between said front concave surface of said antenna and said cover whereby said cover further reduces accumulations of snow and ice on said front concave surface of said antenna while permitting satellite signals to pass therethrough;

an enclosure that is positioned adjacent said antenna;

an inlet tube connecting said enclosure to said enclosed unobstructed space between said cover and said antenna wherein said inlet tube is mounted on said lip of said antenna;

a heater positioned within said enclosure, wherein said heater heats air;

a blower positioned within said enclosure wherein said blower blows air heated by said heater into said inlet tube whereby said heated air travels to said enclosed unobstructed space so that said heated air circulates through said enclosed unobstructed space so that heated air is circulated over said front concave surface and over the inside of said cover and thereby heats said front concave surface of said antenna and also simultaneously heats said cover to maintain said cover at a temperature so that accumulations of snow and ice on the outside surface of said cover is reduced.

8. The system of claim 7, further comprising an outlet tube interconnecting said enclosure and said space wherein air within said space is removed from said space via said outlet tube and provided to said heater.

9. The system of claim 8, wherein said heater is comprised of an electric heating element that is mounted on a first surface of said enclosure and said electric heating element has a helixical shape.

10. The system of claim 9, wherein said blower draws air from said outlet tube through the center of said helixically shaped heating element and then urges said air into said input tube.

11. The system of claim 10, further comprising an inlet fitting which is attached to said input tube and is positioned so as to extend through an opening in said cover and wherein said inlet fitting is configured so as to circulate said heated air in said space so that substantially all of said cover is maintained at a temperature above freezing to prevent either the formation of ice on said cover or the adherence of wet snow to said cover.

12. The system of claim 11, further comprising an outlet fitting which is attached to said outlet tube and is positioned so as to extend through an opening in said cover and wherein said outlet fitting is configured so as to remove air from said space.

13. The system of claim 12, wherein said inlet fitting and said outlet fitting are configured to circulate said heated air in said space so that said heated air circulates in a generally clockwise pattern around said space.

* * * * *